United States Patent [19]

Stodola

[11] 4,320,886

[45] Mar. 23, 1982

[54] CHRISTMAS TREE SPACER

[76] Inventor: George J. Stodola, P.O. Box 734, Crystal River, Fla. 32629

[21] Appl. No.: 127,537

[22] Filed: Mar. 6, 1980

[51] Int. Cl.[3] ..... F16M 13/00

[52] U.S. Cl. ..... 248/523

[58] Field of Search ..... 248/523, 524, 527, 529; 403/362, 365

[56] References Cited

U.S. PATENT DOCUMENTS

| | | | |
|---|---|---|---|
| 1,421,398 | 7/1922 | Burchess | 248/523 |
| 1,855,762 | 4/1932 | Kaminski | 248/527 X |
| 2,537,826 | 1/1951 | Hauser | 248/524 |

FOREIGN PATENT DOCUMENTS

| | | | |
|---|---|---|---|
| 478647 | 1/1938 | United Kingdom | 248/527 |

*Primary Examiner*—Peter P. Nerbun

*Attorney, Agent, or Firm*—Edward D. Gilhooly

[57] ABSTRACT

A Christmas tree spacer for aligning and supporting the pole or trunk of a Christmas tree in a conventional tree stand. The spacer is in the form of a sleeve member having a plurality of openings receiving the threaded members of the tree stand. The spacer permits rapid alignment and securement of the tree to the stand with a minimum of effort. A plurality of slots formed on the exterior permit insertion of the spacer into the typical collar provided on tree stands.

2 Claims, 5 Drawing Figures

CHRISTMAS TREE SPACER

BACKGROUND OF THE INVENTION

This invention relates in general to support assemblies and, in particular, to a spacer for Christmas trees.

More specifically, but without restriction to the particular use which is shown and described, this invention relates to a spacer for receiving the upright shaft, pole or trunk of an artificial or natural Christmas tree and to instantly align the tree in cooperation with a conventional tree stand.

Christmas trees are commonly erected through the use of a stand that includes a base having an upper collar to receive the bottom end of a tree shaft, pole or trunk. Generally, a plurality of threaded bolts extend through the stand collar and are threaded into contact with the tree for support. In many cases, three such threaded bolts are used in known tree stands to engage the tree at separate points. However, each of the threaded bolts of the stand require independent manipulation, and it is difficult to attain accurate vertical alignment of the tree. Known stands require a trial by error technique until the desired orientation is accomplished. None of the tree stands employed in the prior art permit the tree shaft, pole or trunk to be inserted into the stand and be instantaneously oriented in a proper vertical position. Accordingly, it is desirable to provide a technique of securing a Christmas tree that permits the tree to be attached on the Christmas tree stand in its proper upright position, eliminating the significant amount of trial and error required in the past.

SUMMARY OF THE INVENTION

It is, therefore, an object of this invention, to improve the support of Christmas trees Another object of this invention is to accomplish the proper erection of a Christmas tree on a stand with a minimum of effort.

A further object of this invention is to secure the shaft or trunk of a Christmas tree to a stand through the use of an improved spacer having a plurality of holes corresponding to the threaded bolts of the stand.

These and other objects are attained in accordance with the present invention wherein there is provided a spacer for use with Christmas trees, such as, for example, artificial trees in the form of a molded plastic or aluminum. The shaft of the trees may be inserted into the improved spacer of the invention and the tree can be easily attached to a conventional tree stand in immediate alignment.

BRIEF DESCRIPTION OF THE DRAWINGS

Further objects of the invention, together with additional features contributing thereto and advantages accruing therefrom, will be apparent from the following description of the preferred embodiment of the invention, which is shown in the accompanying drawing with like reference numerals indicating corresponding parts throughout, wherein.

DESCRIPTION OF THE PREFERRED EMBODIMENT

Figure 1:
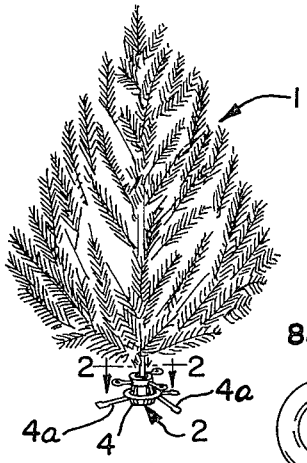
FIG. 1 is a front perspective view of a Christmas tree supported on a stand in conjunction with the improved spacer of the invention.

Referring now to FIG. 1, there is illustrated a tree 1 being supported by a conventional stand 2 in conjunction with the spacer of the invention. The tree 1 may be any type of tree, such as, for example, a Christmas tree having a machined aluminum or molded plastic construction. Such a tree generally includes a bottom support shaft or pole 3 of a predetermined diameter, which dimension may vary from manufacturer to manufacturer.

Figure 2:
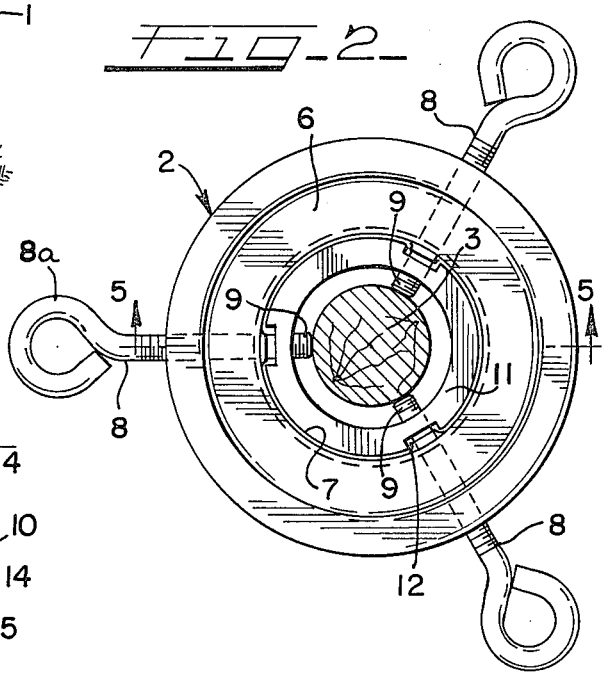
FIG. 2 is a sectional view taken along line 2—2 of FIG. 1.
Figure 3:
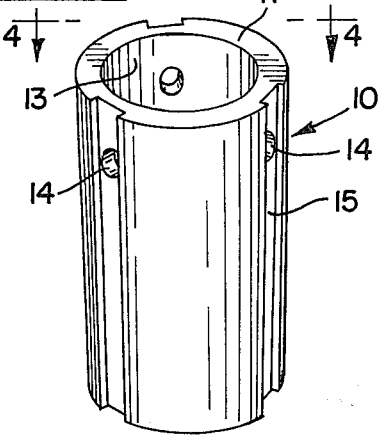
FIG. 3 is a side schematic view, to an enlarged scale, showing the spacer of the invention.
Figure 4:
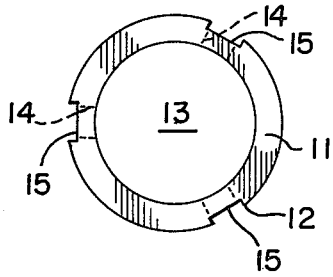
FIG. 4 is a top view taken along line 4—4.
Figure 5:
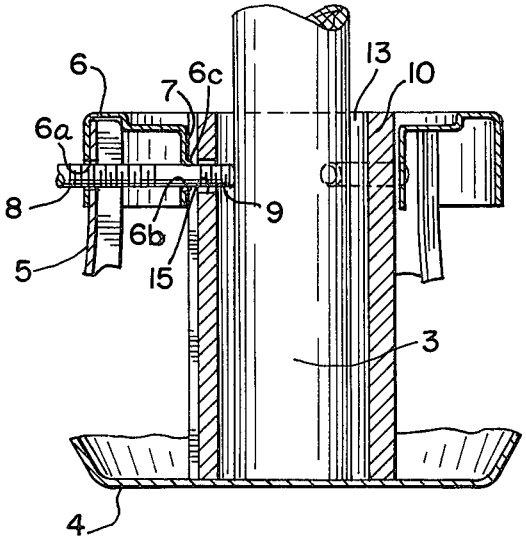
FIG. 5 is a sectional view taken along line 5—5 of FIG. 2.

Referring now to FIG. 2, the stand of the invention is better shown having a shaft or pole 3 of the tree 1 in attachment thereon. Although the spacer of the invention may be employed with conventional tree stands of a wide variety of designs, for purposes of illustration, the stand 2, as best shown in FIGS. 1, 2 and 5, is disclosed in conjunction with the improved spacer of the invention. Stand 2 includes a base 4, in the form of a pan-like structure, having a plurality of outwardly extending legs 4*a*, which aid in providing stability of the erected tree 1.

The base 4 retains the bottom ends of slightly curved upward extending braces 5. The upper ends of braces 5 carry a collar 6 in the form of an annular-like, opened bottom member having an upper portion and a pair of lateral inner and outer portions, concentrically forming a tree receiving opening 7. Three sets of aligned openings 6*a* and 6*b* extend through the inner and outer lateral portions of the collar 6. For reasons of economy, openings 6*a* and 6*b* are normally punched out during manufacture to form an area 6*c* that projects beyond the surface of collar 6. The threaded shafts 8 rotatably engage apertures 6*a* and 6*b* and have an outer end in the form of an I-bolt-like head 8*a* and an inner end 9 to engage a portion of the outer surface of the tree shaft 3. The weight of the tree 1 is generally carried by the base 4, while the threaded bolts 8 provide the necessary lateral stability for the tree and retention on the stand to prevent it from tipping over and the like.

Referring to FIGS. 2 through 5, the spacer 10 of the invention is shown. The spacer 10 is in the form of a cylindrical-like body 11 or other suitable shape in the form of a surface of revolution, which may be fabricated from a plastic or a metal material. The cylindrical body 11 forms a longitudinally extending central opening 13 that is selected to have a diameter approximately equaling the diameter of the shaft or pole 3 of a particular tree 1 with which the spacer 10 of the invention is being utilized. The upper portion of the spacer 10 is provided with a plurality of openings 14. The openings 14 are arranged to be in horizontal alignment with the apertures 6*a* and 6*b* of collar 6 when the spacer 10 is positioned with its lower end flush with the upper surface of base 4 as shown in FIG. 5.

The openings 14 of spacer 10 are situated in external slots 15 formed on the outer periphery of the spacer 15. The slots 15 permit the insertion of the sleeve or the spacer 10 into the center 7 of the stand collar 6 with the pushed out areas 6*c* around apertures 6*b* being aligned in the slots 15, while the remainder of the peripheral surface of spacer 10 is in substantial contact with the inner surface of collar 6. Thus, when the tree is inserted into the opening 13 of spacer 10, the tree automatically assumes the correct vertical orientation established by the spacer 10, and the bolts 8 may be merely rotated into tighter contact with the tree shaft 3 for tightening. It should also be apparent that the punched out area 6*c* aides, through engagement in slots 15, to align the openings 14 in proper orientation with respective apertures 6*a* and 6*b* insuring rapid erection of the tree.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A spacer for use with the erection and support of a Christmas tree comprising a hollow body having a central opening of a diameter substantially corresponding to the diameter of the tree shaft, said hollow body including a plurality of openings adapted to be aligned with the threaded shafts of a Christmas tree stand for insertion therethrough, said hollow body having a flat bottom surface to bear against a portion of the Christmas tree stand, said openings being located at a position from a lower end of said body equal to the position of the threaded shafts on the stand supporting a Christmas tree, said body providing lateral stability and instantaneous alignment of the tree during attachment to the tree stand, and said openings are positioned in longitudinal external slots formed parallel to the longitudinal axis of said body.

2. The spacer of claim 1 wherein said hollow body is a cylinder.

* * * * *